US011828044B2

(12) United States Patent
Hamada et al.

(10) Patent No.: US 11,828,044 B2
(45) Date of Patent: Nov. 28, 2023

(54) WORK ANALYSIS DEVICE AND METHOD OF WORK ANALYSIS

(71) Applicant: KOMATSU LTD., Tokyo (JP)

(72) Inventors: Shintaro Hamada, Tokyo (JP); Minami Sugimura, Tokyo (JP)

(73) Assignee: KOMATSU LTD., Tokyo (JP)

( * ) Notice: Subject to any disclaimer, the term of this patent is extended or adjusted under 35 U.S.C. 154(b) by 592 days.

(21) Appl. No.: 16/975,492

(22) PCT Filed: Mar. 13, 2019

(86) PCT No.: PCT/JP2019/010234
§ 371 (c)(1),
(2) Date: Aug. 25, 2020

(87) PCT Pub. No.: WO2019/181685
PCT Pub. Date: Sep. 26, 2019

(65) Prior Publication Data

US 2021/0032846 A1 Feb. 4, 2021

(30) Foreign Application Priority Data

Mar. 19, 2018 (JP) ..... 2018-051801

(51) Int. Cl.
*E02F 9/20* (2006.01)
*E02F 9/26* (2006.01)

(52) U.S. Cl.
CPC ..... *E02F 9/2025* (2013.01); *E02F 9/264* (2013.01)

(58) Field of Classification Search
CPC ..... E02F 9/2025; E02F 9/264
See application file for complete search history.

(56) References Cited

U.S. PATENT DOCUMENTS

| | | | | |
|---|---|---|---|---|
| 6,263,254 | B1 * | 7/2001 | Nishimura | G05B 19/41865 700/97 |
| 9,691,025 | B2 * | 6/2017 | Kirsch | E02F 9/264 |
| 2014/0060018 | A1 | 3/2014 | Ma et al. | |
| 2015/0261287 | A1 | 9/2015 | Ishihara | |
| 2016/0078340 | A1 | 3/2016 | Kirsch | |

FOREIGN PATENT DOCUMENTS

| | | | |
|---|---|---|---|
| CN | 104603372 | A | 5/2015 |
| JP | 2000-204606 | A | 7/2000 |
| JP | 2014-214566 | A | 11/2014 |
| JP | 2015-175630 | A | 10/2015 |
| JP | 2015-190114 | A | 11/2015 |
| JP | 2016-9317 | A | 1/2016 |

OTHER PUBLICATIONS

The International Search Report for the corresponding international application No. PCT/JP2019/010234, dated Jun. 4, 2019.

* cited by examiner

*Primary Examiner* — Tyler J Lee
(74) *Attorney, Agent, or Firm* — Global IP Counselors, LLP

(57) ABSTRACT

A work analysis device includes a state data acquisition unit state, a work specification unit, and an output unit. The data acquisition unit acquires state data indicating a state of a work machine. The work specification unit specifies, based on the acquired state data, a classification of work of the work machine for each of the multiple times, and collects the classification of work in a chronological order. The output unit outputs a time series of the specified classification of work.

5 Claims, 10 Drawing Sheets

WORK ANALYSIS DEVICE AND METHOD OF WORK ANALYSIS

CROSS-REFERENCE TO RELATED APPLICATIONS

This application is a U.S. National stage application of International Application No. PCT/JP2019/010234, filed on Mar. 13, 2019. This U.S. National stage application claims priority under 35 U.S.C. § 119(a) to Japanese Patent Application No. 2018-051801, filed in Japan on Mar. 19, 2018, the entire contents of which are hereby incorporated herein by reference.

BACKGROUND

Field of the Invention

The present invention relates to a work analysis device and a method of work analysis for a work machine.

Background Information

A technology is known to evaluate work of a work machine by collecting action information related to actions of the work machine. Japanese Unexamined Patent Application, First Publication No. 2014-214566 discloses a technology that evaluates a work content of a work machine on the basis of time-dependent changes of several operating variables depending on an operation state of the work machine.

SUMMARY

When skill of an operator is judged and evaluated, and work is analyzed, it is necessary to output, to a work analysis device, information for comprehensively recognizing an estimation result of work so as to facilitate an evaluation.

A purpose of the present invention is to provide a work analysis device and a method of work analysis for outputting information for comprehensively recognizing an estimation result of work.

A work analysis device according to one aspect of the present invention includes a state data acquisition unit configured to acquire state data indicating a state of a work machine at multiple times, a work specification unit configured to specify, on the basis of the acquired state data, a classification of work of the work machine for each of the multiple times, and configured to collect the classification of work in a chronological order, and an output unit configured to output a time series of the specified classification of work.

According to the above aspect, the work analysis device is capable of outputting information for comprehensively recognizing an estimation result of work of the work machine.

DETAILED DESCRIPTION OF EMBODIMENT(S)

<Overall Structure>

Figure 1:
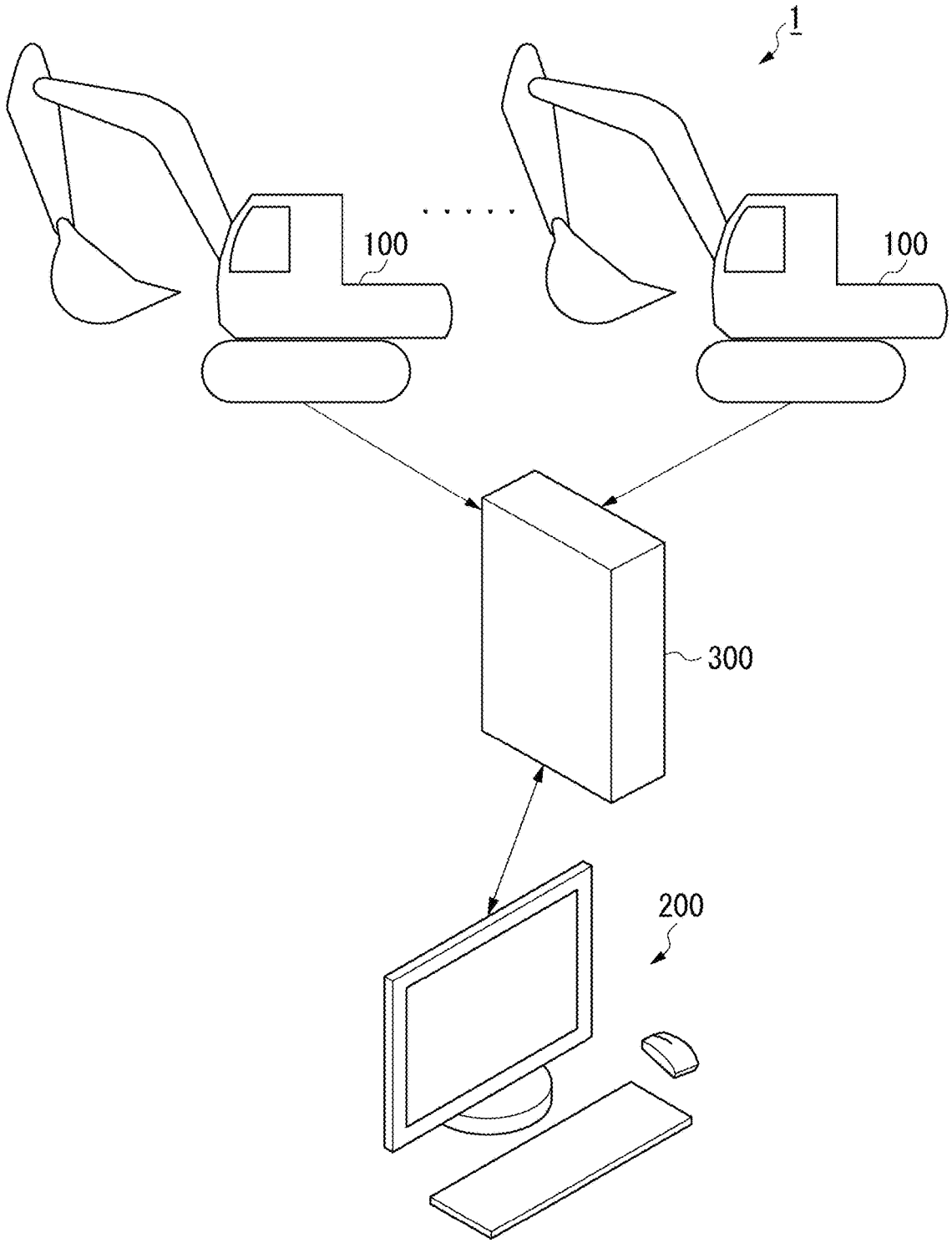
FIG. 1 is a view schematically showing a configuration of a work analysis system according to an embodiment.

FIG. 1 is a view schematically showing one example of a work analysis system according to an embodiment.

A state analysis system includes work machines 100, a work analysis device 300, and a labeling device 200.

The work machine 100 is a target of work analysis by the work analysis device 300. Examples of the work machine 100 include a hydraulic excavator, a wheel loader, and the like. In the first embodiment, the hydraulic excavator will be described as an example of the work machine 100. The work machine 100 is provided with a plurality of sensors and an imaging device, and information related to measurement values of each sensor and a moving image are transmitted to the work analysis device 300.

The labeling device 200 generates label data in which the moving image stored in the work analysis device 300 is labeled with a label indicating a classification of work of the work machine 100 at that time. That is, the label data is a time series of labels indicating the classifications of work.

The work analysis device 300 outputs a picture indicating the classifications of work of the work machine 100 based on a model learned based on the information received from the work machine 100 and the label data received from the labeling device 200. It is possible for a user to recognize the work of the work machine 100 by viewing the picture output by the work analysis device 300.

<Hydraulic Excavator>

Figure 2:
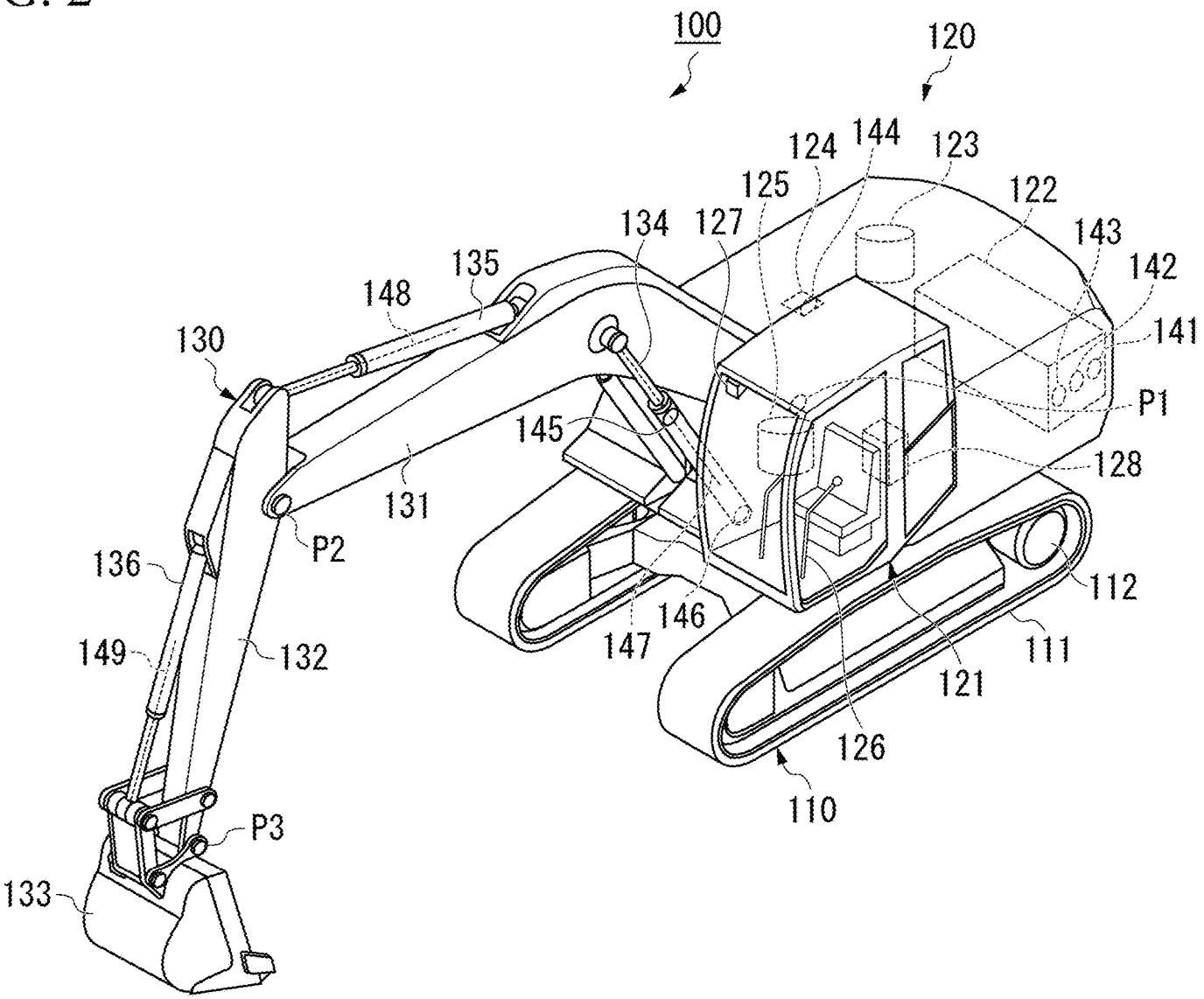
FIG. 2 is a perspective view showing a structure of a hydraulic excavator according to a first embodiment.

FIG. 2 is a perspective view showing a structure of the hydraulic excavator according to a first embodiment.

The work machine 100 includes a carriage 110, a swing body 120 supported by the carriage 110, and a work equipment 130 that is operated by hydraulic pressure and is supported by the swing body 120. The swing body 120 is supported by the carriage 110 such that the swing body 120 is capable of revolving around a revolving center.

The carriage 110 includes continuous tracks 111 provided on the left and right and two drive motors 112 for driving each continuous track 111.

The work equipment 130 includes a boom 131, an arm 132, a bucket 133, a boom cylinder 134, an arm cylinder 135, and a bucket cylinder 136.

A base end of the boom 131 is attached to the swing body 120 via a boom pin P1.

The arm 132 connects the boom 131 and the bucket 133. A base end of the arm 132 is attached to a tip end of the boom 131 via an arm pin P2.

The bucket 133 includes a teeth for excavating earth and the like, and an accommodating unit for accommodating the excavated earth. A base end of the bucket 133 is attached to a tip end portion of the arm 132 via a bucket pin P3. The bucket 133 may be a bucket for the purpose of leveling, such as a slope bucket, or may be a bucket that does not include the accommodating unit. The work equipment 130 may include, instead of the bucket 133, a breaker for giving a crushing force by hitting, or another attachment such as a grapple for gripping an object.

The boom cylinder 134 is a hydraulic cylinder for operating the boom 131. A base end of the boom cylinder 134 is attached to the swing body 120. A tip end of the boom cylinder 134 is attached to the boom 131.

The arm cylinder 135 is a hydraulic cylinder for driving the arm 132. A base end of the arm cylinder 135 is attached to the boom 131. A tip end of the arm cylinder 135 is attached to the arm 132.

The bucket cylinder 136 is a hydraulic cylinder for driving the bucket 133. A base end of the bucket cylinder 136 is attached to the arm 132. A tip end of the bucket cylinder 136 is attached to the bucket 133.

The swing body 120 includes a cab 121 on which an operator rides. The cab 121 is provided in front of the swing body 120 and on the left side of the work equipment 130.

The swing body 120 includes an engine 122, a hydraulic pump 123, a control valve 124, a swing motor 125, an operation device 126, an imaging device 127, and a data collecting device 128. In another embodiment, the work machine 100 may be operated by a remote control via a network, or may be operated automatically. In this case, the work machine 100 does not need to include the cab 121 and the operation device 126.

The engine 122 is a prime mover that drives the hydraulic pump 123.

The hydraulic pump 123 is driven by the engine 122 and supplies hydraulic oil to each actuator (the boom cylinder 134, the arm cylinder 135, the bucket cylinder 136, the drive motor 112, and the swing motor 125) via the control valve 124.

The control valve 124 controls a flow rate of the hydraulic oil supplied from the hydraulic pump 123.

The swing motor 125 is driven by the hydraulic oil supplied from the hydraulic pump 123 via the control valve 124 to swing the swing body 120.

The operation device 126 consists of two levers provided inside the cab 121. The operation device 126 accepts commands, regarding a raising operation and a lowering operation of the boom 131, a pushing operation and a pulling operation of the arm 132, an excavation operation and a dumping operation of the bucket 133, a right swing operation and a left swing operation of the swing body 120, and a forward operation and a backward operation of the carriage 110. Specifically, the forward operation of the right operation lever corresponds to a command for lowering the boom 131. The rearward operation of a right operation lever corresponds to a command for raising the boom 131. The rightward operation of the right operation lever corresponds a command for dumping for the bucket 133. The leftward operation of the right operation lever corresponds to an excavating command for the bucket 133. The forward operation of the left operation lever corresponds to a command for pulling the arm 132. The rearward operation of the left operation lever corresponds to a command for pushing the arm 132. The rightward operation of the left operating lever corresponds to a command for a rightward turning operation of the swing body 120. The leftward operation of the left operating lever corresponds to a command for a leftward turning operation of the swing body 120.

The opening of a flow path connected to each actuator of the control valve 124 is controlled according to an inclination of the operation device 126. The operation device 126 has a valve that changes the flow rate of a pilot hydraulic oil in accordance with, for example, the inclination, and the pilot hydraulic oil controls the opening of the control valve 124 by operating the spool of the control valve 124.

The imaging device 127 is provided in an upper part of the cab 121. The imaging device 127 captures a moving image of the working equipment 130, which is an image in front of the cab 121. The moving image captured by the imaging device 127 is stored in the data collecting device 128 together with a time stamp.

The data collecting device 128 collects detection values from a plurality of sensors included in the work machine 100, and stores the detection values in association with the time stamp. The data collecting device 128 also transmits the time series of the detection values collected from the plurality of sensors and the moving image captured by the imaging device 127 to the work analysis device 300. The detection values of the sensors and the moving image are examples of state data indicating a state of the work machine 100. The data collecting device 128 is a computer including a processor, a main memory, a storage, and an interface which are not shown. A storage of the data collecting device 128 stores a data collecting program. The processor of the data collecting device 128 reads the data collecting program from the storage, expands it in the main memory, and executes a collecting processing and a transmitting processing for the detection values and the moving image according to the data collecting program. The data collecting device 128 may be provided inside the work machine 100 or outside the work machine 100.

The work machine 100 includes the plurality of sensors. Each sensor outputs a measured value to the data collecting device 128. Specifically, the work machine 100 includes a rotation speed sensor 141, a torque sensor 142, a fuel sensor 143, a pilot pressure sensor 144, a boom cylinder head pressure sensor 145, a boom cylinder bottom pressure sensor 146, a boom stroke sensor 147, an arm stroke sensor 148, and a bucket stroke sensor 149.

The rotation speed sensor 141 is provided in the engine 122 and measures a rotation speed of the engine 122.

The torque sensor 142 is provided in the engine 122 and measures a torque of the engine 122.

The fuel sensor 143 is provided in the engine 122 and measures an amount of a fuel consumed by the engine (instantaneous fuel consumption).

The pilot pressure sensor 144 is provided in the control valve 124 and measures a pressure (PPC pressure) of each pilot hydraulic oil from the operation device 126. Specifically, the pilot pressure sensor 144 measures, a PPC pressure related to the raising operation of the boom 131 (boom raising PPC pressure), a PPC pressure related to the lowering operation of the boom 131 (boom lowering PPC pressure), a PPC pressure related to the pushing operation of the arm 132 (arm pushing PPC pressure), a PPC pressure related to the pulling operation of the arm 132 (arm pulling PPC pressure), a PPC pressure related to the excavation operation of the bucket 133 (bucket excavation PPC pressure), a PPC pressure related to the dumping operation of the bucket 133 (bucket dump PPC pressure), a PPC pressure related to the right swing operation of the swing body 120 (right swing PPC pressure), a PPC pressure related to the left swing operation of the swing body 120 (left swing PPC pressure), a PPC pressure related to the forward operation of the left continuous track 111 (left forward PPC pressure), a PPC pressure related to the backward operation of the left continuous track 111 (left backward PPC pressure), a PPC pressure related to the forward operation of the right continuous track 111 (right forward PPC pressure), and a PPC pressure related to the backward operation of the right continuous track 111 (right backward PPC pressure). In another embodiment, the pilot pressure sensor 144 may be replaced with a detector which detects an operation signal which the operation device 126 outputs.

The boom cylinder head pressure sensor 145 measures a pressure in an oil chamber on the head side of the boom cylinder 134.

The boom cylinder bottom pressure sensor 146 measures a pressure in an oil chamber on the bottom side of the boom cylinder 134.

The boom stroke sensor 147 measures a stroke amount of the boom cylinder 134.

The arm stroke sensor 148 measures a stroke amount of the arm cylinder 135.

The bucket stroke sensor 149 measures a stroke amount of the bucket cylinder 136. In another embodiment, each stroke sensor may be replaced with an angle meter which directly measures an angle of the working equipment 130, or an inclinometer and IMU provided on the boom 131, the arm 132, and the bucket 133, respectively. Further, in another embodiment, an angle of the work equipment 130 may be calculated from the image of the work equipment 130 captured by the imaging device 127.

The data collecting device 128 may specify other state data of the work machine 100 based on the measurement value of each sensor. For example, the data collecting device 128 may calculate an actual weight of the work equipment 130 based on the measurement value of the boom cylinder bottom pressure sensor 146. The data collecting device 128 may calculate a lifting height of the work equipment 130 based on the measurement values of the boom stroke sensor 147, the arm stroke sensor 148, and the bucket stroke sensor 149, for example.

<Configuration of Labeling Device>

Figure 3:
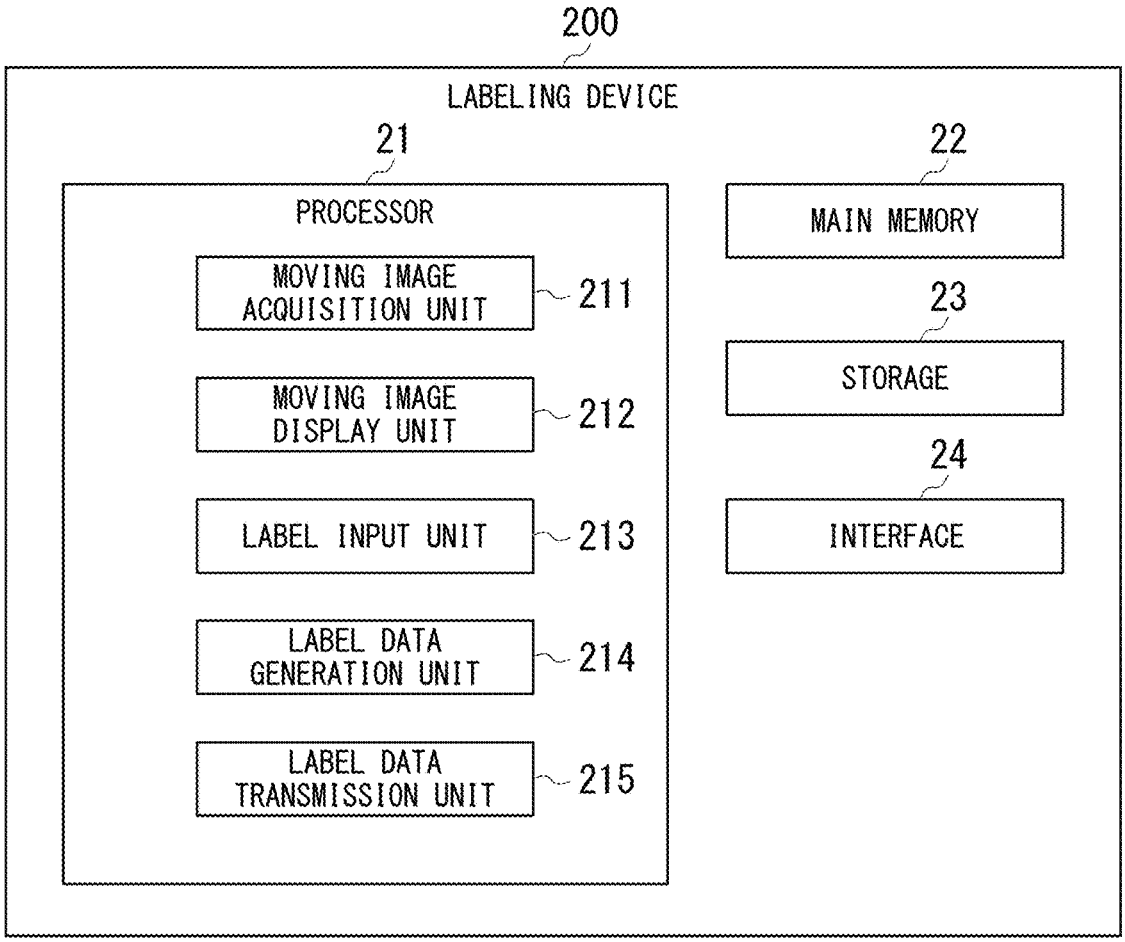
FIG. 3 is a schematic block diagram showing a configuration of a labeling device according to the first embodiment.

FIG. 3 is a schematic block diagram showing a configuration of the labeling device according to the first embodiment.

The labeling device 200 is a computer including a processor 21, a main memory 22, a storage 23, and an interface 24. Examples of the labeling device 200 include a PC, a smartphone, a tablet terminal, and the like. The labeling device 200 may be installed anywhere. That is, the labeling device 200 may be mounted on the work machine 100, may be mounted on the work analysis device 300, or may be provided separately from the work machine 100 or the work analysis device 300. The storage 23 stores a labeling program. The processor 21 reads the labeling program from the storage 23, expands it in the main memory 33, and executes processing according to the labeling program.

Examples of the storage 23 include a semiconductor memory, a disk media, a tape media, and the like. The storage 23 may be an internal medium directly connected to a common communication line of the labeling device 200 or an external medium configured to be connected to the labeling device 200 via the interface 24. The storage 23 is a non-transitory tangible storage medium.

The processor 21 includes a moving image acquisition unit 211, a moving image display unit 212, a label input unit 213, a label data generation unit 214, and a label data transmission unit 215 which execute the labeling program.

The moving image acquisition unit 211 receives the moving image from the work analysis device 300. Each frame image of the moving image is associated with a time stamp indicating an image capturing time.

The moving image display unit 212 displays the moving image acquired by the moving image acquisition unit 211 on a display.

The label input unit 213 receives an input of a label value indicating a classification of work performed by the work machine 100 at a reproduction timing from a user during a reproduction of the moving image.

The label data generation unit 214 generates the label data in which label values input to the label input unit 213 are associated with input time stamps each of which indicates the reproduction timing. The label data may be, for example, a matrix having classifications of work as rows and times as columns, and having values, as elements, each of which indicates whether or not work related to the classification is performed at that time. That is, in the label data may be a matrix in which the value wij of an element in the i-th column and the j-th row, is set to 1 in a case where work related to a classification aj is performed at time tj and is set to 0 in a case where work related to the classification aj is not performed at time tj.

The label data transmission unit 215 transmits the label data to the work analysis device 300.

<Example of the Classifications of Work>

An example of the classifications of work input to the label input unit 213 will be described. The label input unit 213 receives an input of label values related to unit works and label values related to element works from the user. The unit work is work that carries out one work goal. The element work is work indicates a series of actions or work classified by purpose, the series of actions or work constituting the unit work.

Examples of the classifications of the element work are "excavation", "loading swing", "dumping", "unloading swing", "waiting for dumping", "dump box pressing", "compaction", "pushing and smoothing", and "broom".

The excavation is work in which the bucket 133 is used to excavate earth or rocks and scrape off earth or rocks.

The loading swing is work of swinging the swing body 120 while holding the scraped earth or rocks in the bucket 133.

The dumping is work of dumping the scraped earth or rocks from the bucket 133 to a transport vehicle or a predetermined place.

The unloading swing is work of swinging the swing body 120 in a state where the bucket 133 is free of earth and rocks.

The waiting for dumping is work of holding the scraped earth or rocks in the bucket 133 while waiting for the transport vehicle for loading.

The dump box pressing is work to flatten soil loaded on a dump box of transportation vehicle by pressing it with the bucket 133 from above.

The compaction is work of pushing earth against the disturbed ground with the bucket 133 to form the ground and strengthen it.

The pushing and smoothing is work in which a bottom surface of the bucket 133 is used to disperse and level earth.

The broom is work in which a side surface of the bucket 133 is used to disperse and level earth.

Examples of the classifications of the unit work are "excavation and loading", "ditch excavation", "backfilling", "plowing", "slope (from above)", "slope (from below)", "collecting load", "driving", and "stop".

The excavation and loading is work of excavate earth or rocks, scraping it, and loading the scraped earth or rocks on the dump box of the transport vehicle. The excavation and loading is the unit work that consists of the excavation, the loading swing, the dumping, the empty load swing, the waiting for dumping, and the dump box pressing.

The ditch excavation is work of digging the ground into a long and narrow groove and scraping it off. The ditch excavation is the unit work that consist of the excavation, the loading swing, the dumping, and the empty load swing, and may include the pushing and smoothing.

The backfilling is work in which earth is put into a groove or hole that is already open in the ground to backfill it and make it flat. The backfilling is the unit work consisting of the excavation, the loading swing, the dumping, the compaction, and the empty load swing, and may include the smoothing and the broom.

The plowing is work to scrape off the ground flatly in order to flatten the undulations to a predetermined height. The plowing is the unit work consisting of the excavation and the dumping, or the excavation, the loading swing, the dumping and the unloading swing, and may include the pushing and smoothing, and the broom.

The slope (from above) is work of making a slope by the work machine 100 located above the target location. The slope (from above) is the unit work that consists of the compaction, the excavation, the loading swing, the dumping, and the unloading swing, and may include the pushing and smoothing.

The slope (from below) is work of making a slope by the work machine 100 located below the target location. The slope (from below) is the unit work that consists of the compaction, the excavation, the loading swing, the dumping, and the unloading swing, and may include the pushing and smoothing.

The collecting load is work of collecting earth generated by excavation or the like, before loading it on the transport vehicle. The collecting load is the unit work that is consisting of the excavation, the loading swing, the dumping, and the unloading swing, and may include the pushing and smoothing.

The driving is work of moving the work machine 100. The driving as the unit work is the unit work that consists of the driving as the element work.

The stop is a state in which there are no earth and rocks in the bucket 133 and the bucket 133 is stopped for a predetermined period or longer. The stop as the unit work is the unit work consisting of the stop as the element work.

Each of the "excavation and loading", the "ditch excavation", the "backfill", the "plowing", the "slope (from above)", and the "slope (from below)" is an example of a main work that is work that contributes to the direct purpose of work. Each of the "collecting load" and the "driving" is an example of an incidental work for performing the main work.

<Configuration of Work Analysis Machine>

Figure 4:
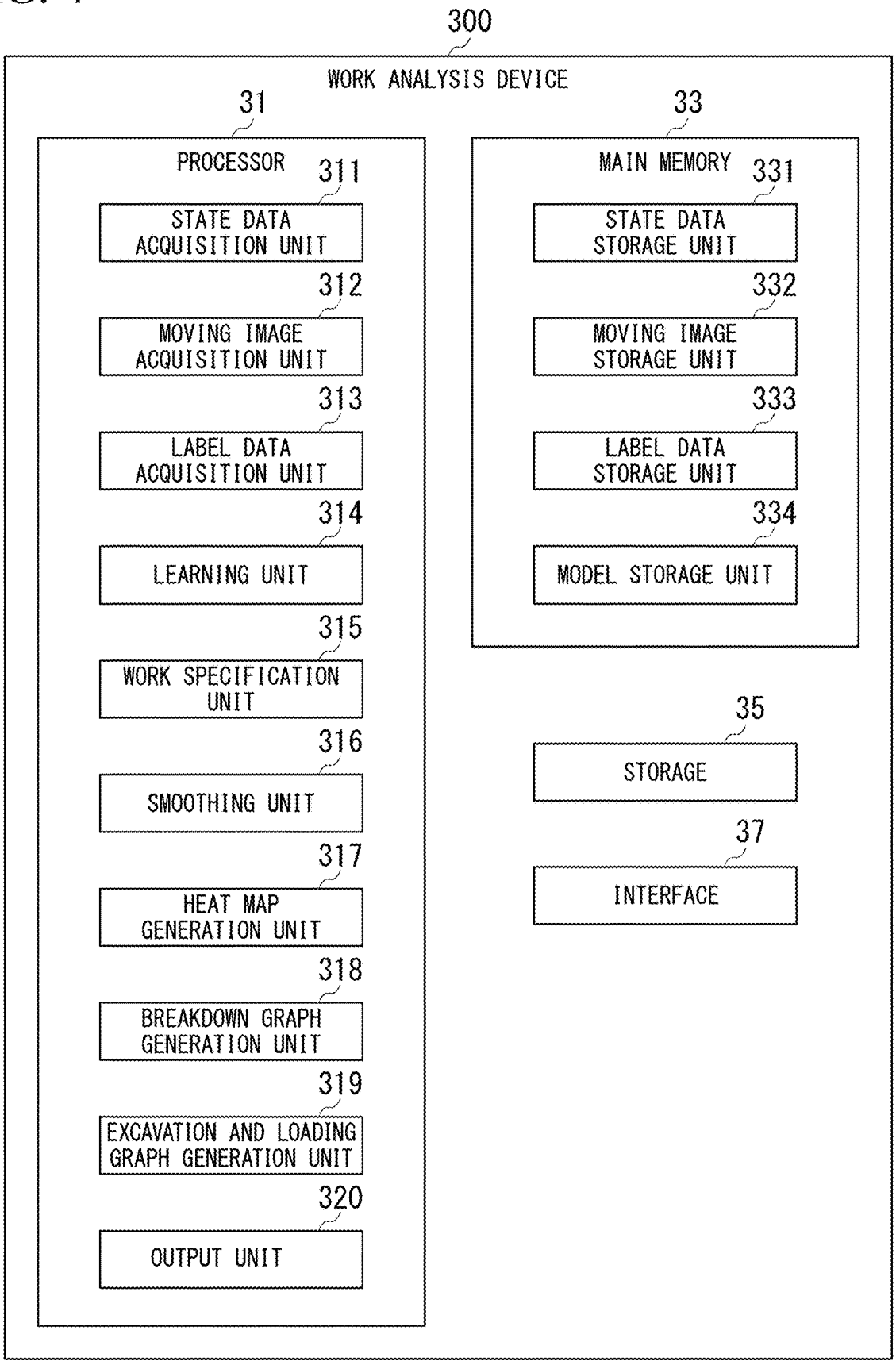
FIG. 4 is a schematic block diagram showing a configuration of a work analysis device according to the first embodiment.

FIG. 4 is a schematic block diagram showing a configuration of the work analysis device according to the first embodiment.

The work analysis device 300 is a computer including a processor 31, a main memory 33, a storage 35, and an interface 37. The storage 35 stores a work analysis program. The processor 31 reads the work analysis program from the storage 35, expands it in the main memory 33, and executes the processing according to the work analysis program. Although the work analysis device 300 according to the first embodiment is provided outside the work machine 100, in another embodiment, some or all of functional units of the work analysis device 300 may be provided inside the work machine 100.

Examples of the storage 35 include a semiconductor memory, a disk media, a tape media, and the like. The storage 35 may be an internal medium directly connected to a common communication line of the work analysis device 300, or may be an external medium configured to be connected to the work analysis device 300 via the interface 37. The storage 35 is a non-transitory tangible storage medium.

In order to execute the work analysis program, the processor 31 includes a state data acquisition unit 311, a moving image acquisition unit 312, a label data acquisition unit 313, a learning unit 314, a work specification unit 315, a smoothing unit 316, a heat map generation unit 317, a breakdown graph generation unit 318, an excavation and loading graph generation unit 319, and an output unit 320. Further, the processor 31 reserves storage areas of a state data storage unit 331, a moving image storage unit 332, a label data storage unit 333, and a model storage unit 334 in the main memory 33 by executing the work analysis program.

The state data acquisition unit 311 acquires a time series of the state data indicating a state of the work machine 100 from the data collecting device 128 of the work machine 100. That is, the state data acquisition unit 311 acquires a plurality of combinations of the time stamps and the state data. The state data may include a measurement value of each sensor of the work machine 100 and a value obtained by the data collecting device 128 based on the measurement value. The state data acquisition unit 311 stores the acquired time series of the state data in the state data storage unit 331 in association with an ID of the work machine 100.

The moving image acquisition unit 312 acquires the moving image captured by the imaging device 127 from the data collecting device 128 of the work machine 100. The moving image acquisition unit 312 stores the acquired moving image in the moving image storage unit 332 in association with the ID of the work machine 100.

The label data acquisition unit 313 acquires the label data for the unit works and the label data for the element works from the labeling device 200. In a case where a frame cycle of the imaging device 127 and a detection cycle of each sensor are different, the label data acquisition unit 313 matches the time stamp of the label data with the time stamp of the state data. For example, the label data acquisition unit 313 reconfigures the time series of the label data so that the time stamp of the label data matches the time stamp of the state data. The label data acquisition unit 313 stores the acquired time series of label data in the label data storage unit 333 in association with the ID of the work machine 100. That is, the label data acquisition unit 313 stores the plurality of combinations of the time stamps and the label data in the label data storage unit 333 in association with the ID of the work machine 100.

The learning unit 314 trains a prediction model by using a combination of the time series of the state data stored in the state data storage unit 331 and the time series of the label data stored in the label data storage unit 333 as teaching data so that the prediction model inputs the time series of the state data using and outputs time series of the classifications of work. Examples of the prediction model include a neural network model, a decision tree model, and a support vector machine model. The learning unit 314 stores the trained the prediction model in the model storage unit 334.

The work specification unit 315 obtains a time series of likelihoods related to the classifications of work based on the time series of new state data acquired by the state data acquisition unit 311 and the prediction model stored in the model storage unit 334. For example, the work specification unit 315 obtains the time series of likelihoods related to the classifications of work by the following procedure. The work specification unit 315 acquires the state data at the time of specifying work from the time series of the state data. Next, the work specification unit 315 specifies the likelihood of each classification of work based on the acquired state data and acquires the result. The work specification unit 315 collects the likelihoods of the classification of work specified for each time point as a time series.

Specifically, the work specification unit 315 obtains a matrix having the classifications of work as rows and times as columns, and a matrix having elements of the likelihoods of work related to the classifications at the time. That is, the time series of the likelihoods may be a matrix in which the value wij of the element in the i-th column and the j-th row is the likelihood of work related to a classification aj at the time tj. The work specification unit 315 specifies the classification of the unit work by the work machine 100 by obtaining the time series of the likelihoods related to the unit work. The work specification unit 315 specifies the classification of the element work by the work machine 100 by obtaining the time series of the likelihoods related to the element work.

The smoothing unit 316 performs a smoothing process on the time series of the likelihoods for each classification of work obtained by the work specification unit 315. For example, the smoothing unit 316 smooths the time series of likelihoods by applying a time average filter to the time series of likelihoods. That is, the smoothing unit 316 specifies a representative value per unit time for each of the time series of the likelihoods of the unit work and the time series of the likelihoods of the element work.

At this time, the size of a window function of the time average filter related to the element work (length of unit time) is smaller than the size of the window function of the time average filter related to the unit work. Note that the smoothing method is not limited to time averaging, but it is preferable that the size of the window function related to the element work is smaller than the size of the window function related to the unit work. This is because a duration of one element work is shorter than a duration of one unit work, as the unit work is consisting of one or more element works.

Figure 5:
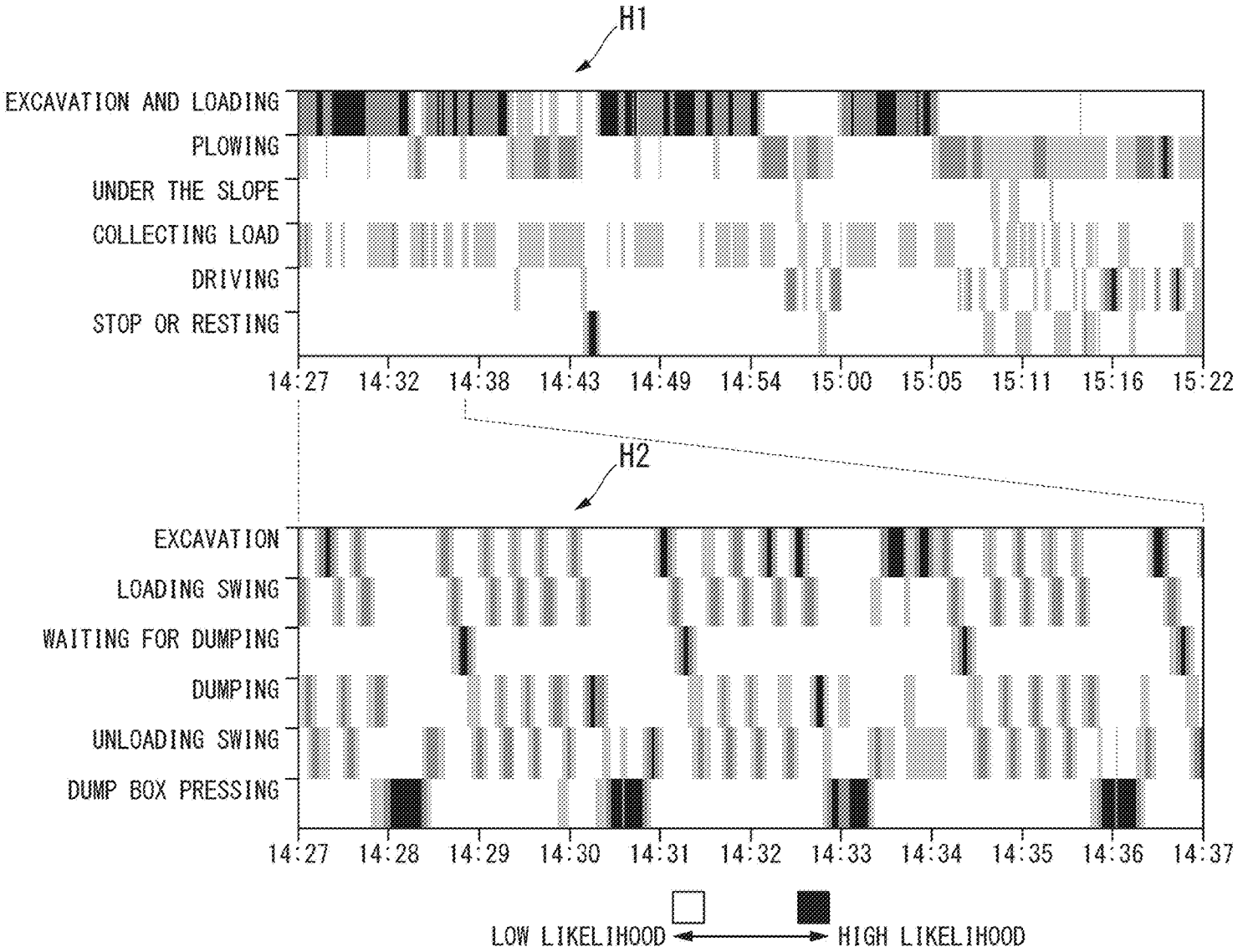
FIG. 5 is a diagram showing an example of a heat map indicating classifications of work.

FIG. 5 is a diagram showing an example of a heat map which indicates classifications of work.

The heat map generation unit 317 generates a colored heat map represented the likelihoods of the classifications of work on a plane in which the vertical axis indicates the classifications of work and the horizontal axis indicates the time, based on the time series of the likelihoods smoothed by the smoothing unit 316. The color in the heat map may be closer to blue as the likelihood of the classification of work is lower, and may be closer to red as the likelihood of the classification of work is higher. Further, the color associated with the heat map may have a lower brightness as the likelihood of the classification of work is lower, and may have a higher brightness as the likelihood of the classification of work is higher. The color mode of the heat map may be any mode as long as it indicates the likelihood value. That is, the heat map may represent the likelihood value in terms of hue, lightness, density, saturation, brightness, or other color aspects.

Specifically, the heat map generation unit 317 generates a unit work heat map H1 indicating the likelihood of the unit work for each time, based on the time series of the likelihoods of the unit works. The heat map generation unit 317 generates an element work heat map H2 that represents the likelihood of the element work for each time, based on the time series of the likelihoods of the element works. At this time, the scale of the horizontal axis in the element work heat map H2 is larger (representing shorter time) than the scale of the horizontal axis in the unit work heat map H1.

Figure 6:
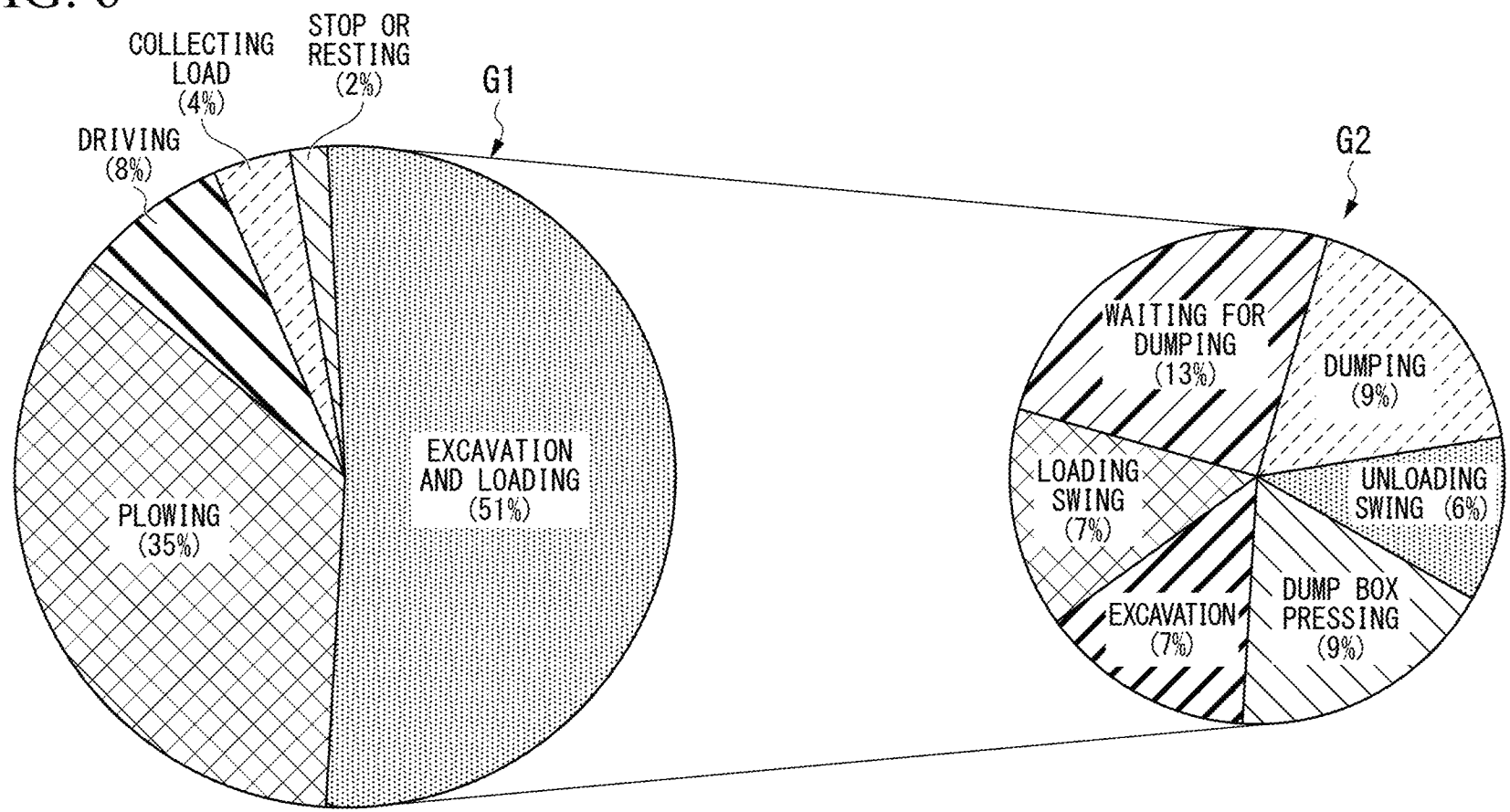
FIG. 6 is a diagram showing an example of a breakdown graph indicating a breakdown of a classification of work.

FIG. 6 is a diagram showing an example of a breakdown graph indicating a breakdown of the classifications of work.

The breakdown graph generation unit 318 generates a pie chart showing a breakdown of the classifications of work in a predetermined time period, based on the time series of the likelihoods smoothed by the smoothing unit 316. Specifically, the breakdown graph generation unit 318 integrates, for each unit work, the time at which the likelihood is the highest as compared with the other unit works, based on the time series of the likelihoods related to the unit works. The breakdown graph generation unit 318 generates a unit work breakdown graph G1 by drawing the accumulated time for each unit work in a pie chart. The breakdown graph generation unit 318 integrates, for each unit work, the time at which the likelihood of each element work is relatively highest in the time related to each unit work, based on the time series of the likelihoods related to the element works. The breakdown graph generation unit 318 generates an element work breakdown graph G2 for each unit work by drawing the accumulated time for each element work for each unit work in a pie chart.

Figure 7:
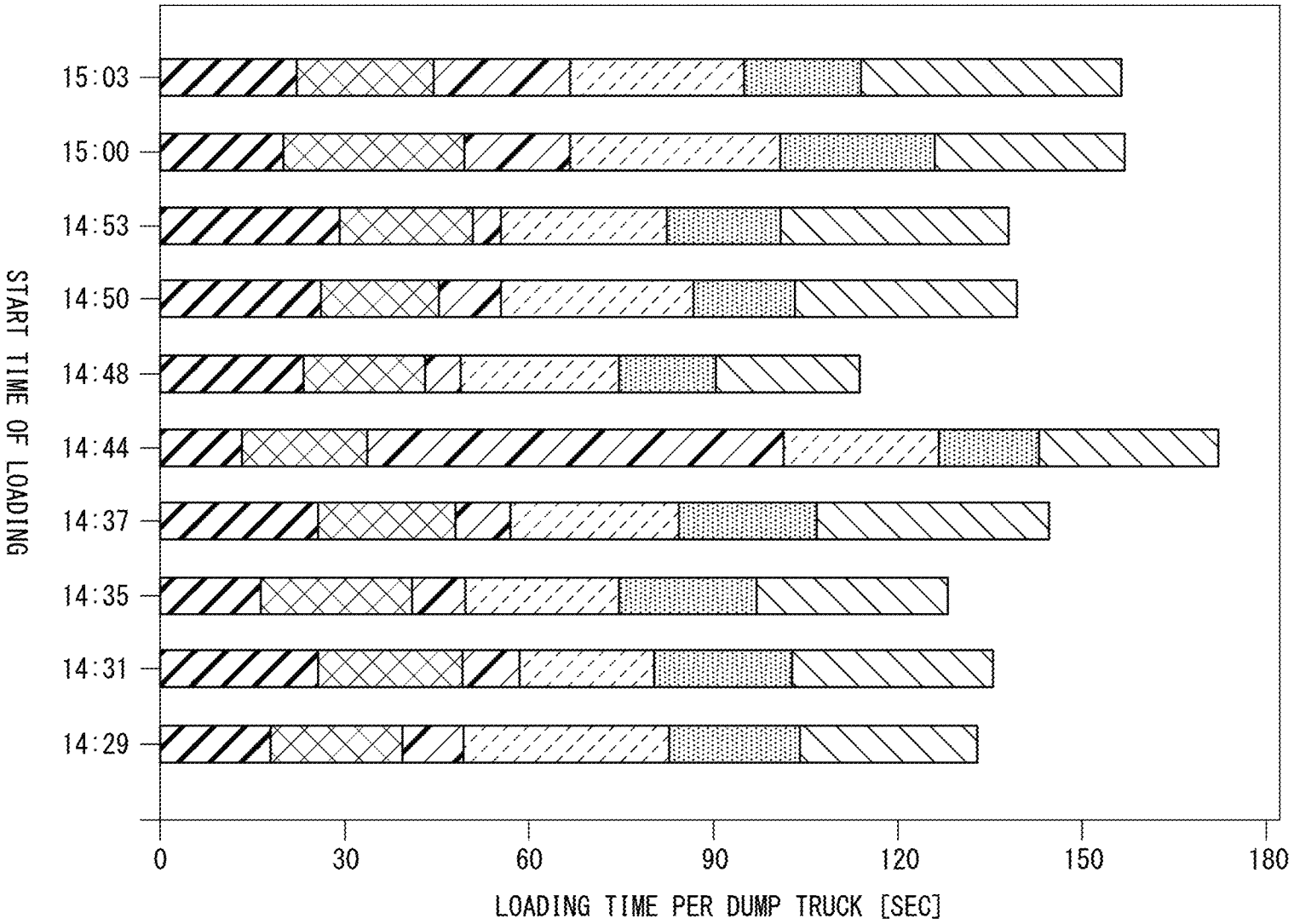
FIG. 7 is a diagram showing an example of a graph indicating a breakdown of element works for each excavation and loading.

FIG. 7 is a diagram showing an example of a graph indicating a breakdown of the element works for each excavation and loading.

Figure 8:
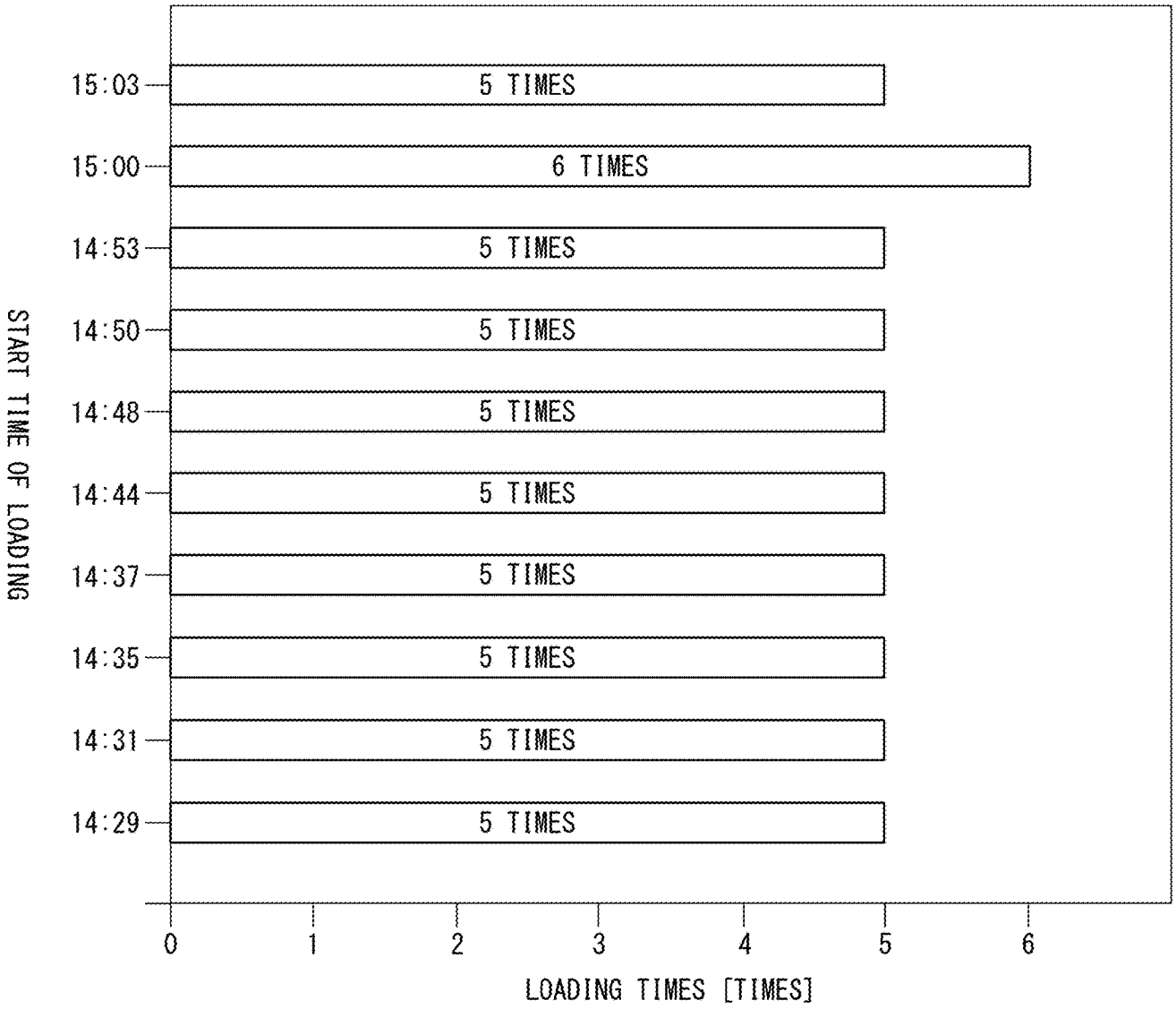
FIG. 8 is a diagram showing an example of a graph indicating a loading frequency for each excavation and loading.

FIG. 8 is a diagram showing an example of a graph indicating a loading frequency for each excavation and loading.

The excavation and loading graph generation unit 319 generates a graph showing information for each excavation and loading based on the time series of the likelihoods related to the unit works and the time series of the likelihoods related to the element works. For example, the excavation and loading graph generation unit 319 generates a graph showing a breakdown of the element works for each excavation and loading as shown in FIG. 7 and a graph showing a loading frequency for each excavation and loading as shown in FIG. 8.

Specifically, the excavation and loading graph generation unit 319 specifies a start time and an end time of the excavation and loading based on the time series of the likelihoods related to the unit works and the time series of the likelihoods related to the element works. For example, the excavation and loading graph generation unit 319 specifies the end time of the "waiting for dumping" in the time period related to the excavation and loading as the start time of the excavation and loading. Further, for example, the excavation and loading graph generation unit 319 specifies the start time of the "dump box pressing" in the time period related to the excavation and loading as the end time of the excavation and loading. In other words, the waiting for dumping is an example of the element work that is capable of specifying the loading start timing, and the dump box pressing is an example of the element work that is capable of specifying the loading end timing.

The excavation and loading graph generation unit 319 obtains collected values regarding the state data or the element works for each specified excavation and loading, and generates a graph showing the collected values regarding the excavation and loading for each transport vehicle. Examples of the collected value include the integrated value of the time for each element work, the number of loadings, and an average fuel consumption. The "excavation and loading" of the unit work is consisting of a plurality of loading works, and the "number of loading" is the number of loading works in one "excavation and loading". One "excavation and loading" is determined based on, for example, the "dumping" or the "dump box pressing". For example, the excavation and loading graph generation unit 319 specifies, as the number of loadings, the number of appearances in the time period in which the "loading swing" is dominant in the time period related to the excavation and loading. That is, the loading swing is an example of the element work related to a loading cycle.

The output unit 320 outputs the heat map generated by the heat map generation unit 317, the breakdown graph generated by the breakdown graph generation unit 318, and the graph indicating information for each excavation and loading generated by the excavation and loading graph generation unit 319. The output by the output unit 320 includes, for example, displaying on a display, printing on a sheet such as paper by a printer, transmitting to an external server connected via a network, writing to an external storage medium connected to the interface 37, or the like. This allows an analyst or other persons to perform comprehensive analysis of a work content at a different place at a time different from the time at which work was performed.

<Method of Learning>

The work analysis device 300 generates the prediction model in advance before performing work analysis of one work machine 100.

Figure 9:
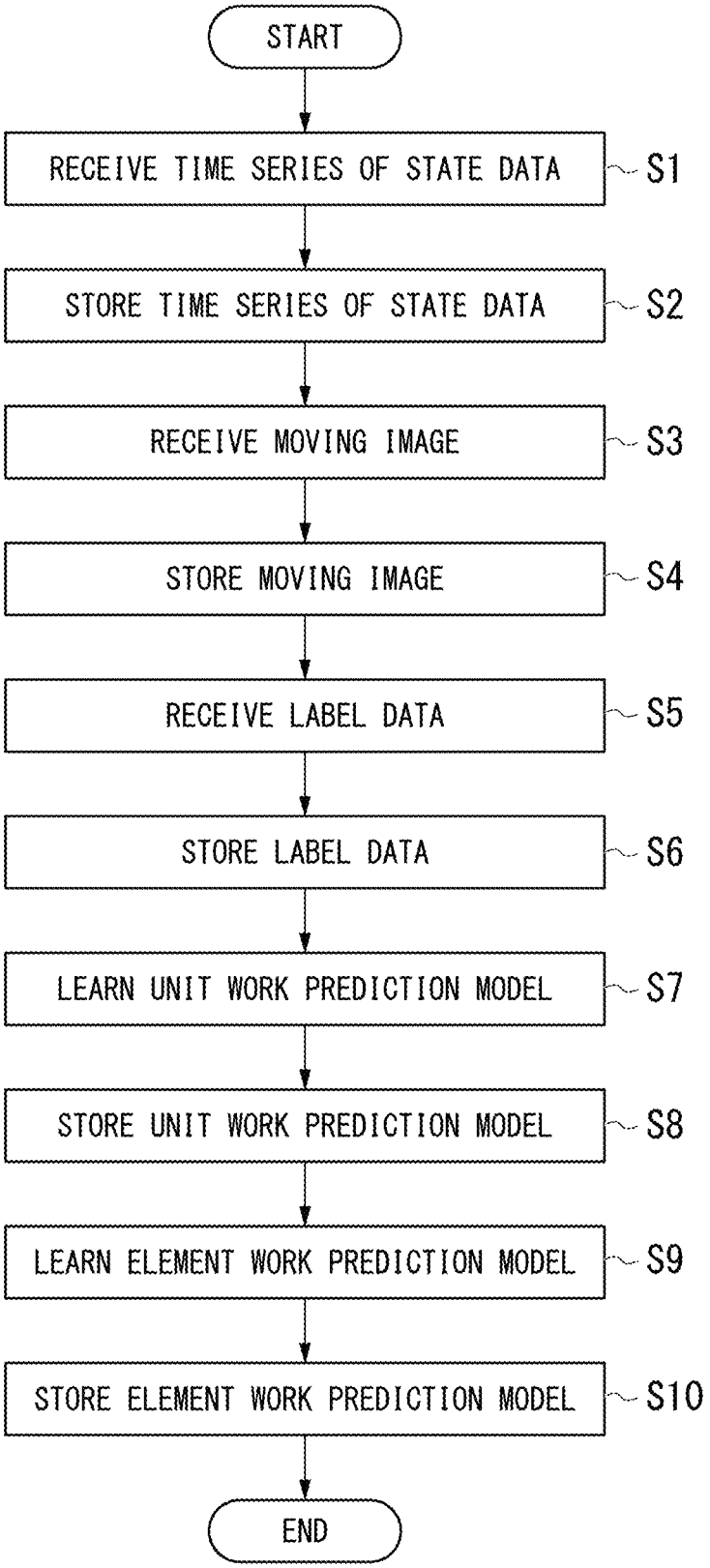
FIG. 9 is a flowchart showing a learning process of the work analysis device according to the first embodiment.

FIG. 9 is a flowchart showing a learning process of the work analysis device according to the first embodiment.

The state data acquisition unit 311 of the work analysis device 300 receives the time series of the state data of the work machine 100 from each of the plurality of work machines 100 (step S1). The state data acquisition unit 311 stores the received time series of the state data in the state data storage unit 331 in association with the ID of the work machine 100 (step S2). In addition, the moving image acquisition unit 312 receives, from each of the plurality of the work machines 100, the moving image captured by the imaging device 127 of the work machine 100 (step S3). The moving image acquisition unit 312 stores the received moving image in the moving image storage unit 332 in association with the ID of the work machine 100 (step S4).

The labeling device 200 acquires the moving image stored in the moving image storage unit 332 and generates the label data according to the user's operation. The labeling device 200 associates the generated label data with the ID of the work machine 100 and transmits it to the work analysis device 300. The labeling device 200 generates the label data for the unit works and the label data for the element works for each of a plurality of moving images by the above processing.

The label data acquisition unit 313 of the work analysis device 300 receives a plurality of label data from the labeling device 200 (step S5). The label data acquisition unit 313 stores the plurality of label data in the label data storage unit 333 in association with the IDs of the work machines 100 (step S6).

Next, the learning unit 314 learns a unit work prediction model by using the time series of a plurality of state data stored in the state data storage unit 331 and the label data of a plurality of unit works stored in the label data storage unit 333 as teaching data (step S7), and the learned unit work prediction model is stored in the model storage unit 334 (step S8). Further, the learning unit 314 learns an element work prediction model by using the time series of the plurality of state data stored in the state data storage unit 331 and the label data of the plurality of the element works stored in the label data storage unit 333 as teaching data (step S9), and the learned element work prediction model is stored in the model storage unit 334 (step S10).

At this time, the learning unit 314 trains the prediction models such that the time series of the state data is input and the label data (matrix indicating the time series for the classification of each work) is output.

<Method of Work Analysis>

When the above preparation is completed, the work analysis device 300 is capable of analyzing work of any work machine 100.

Figure 10:
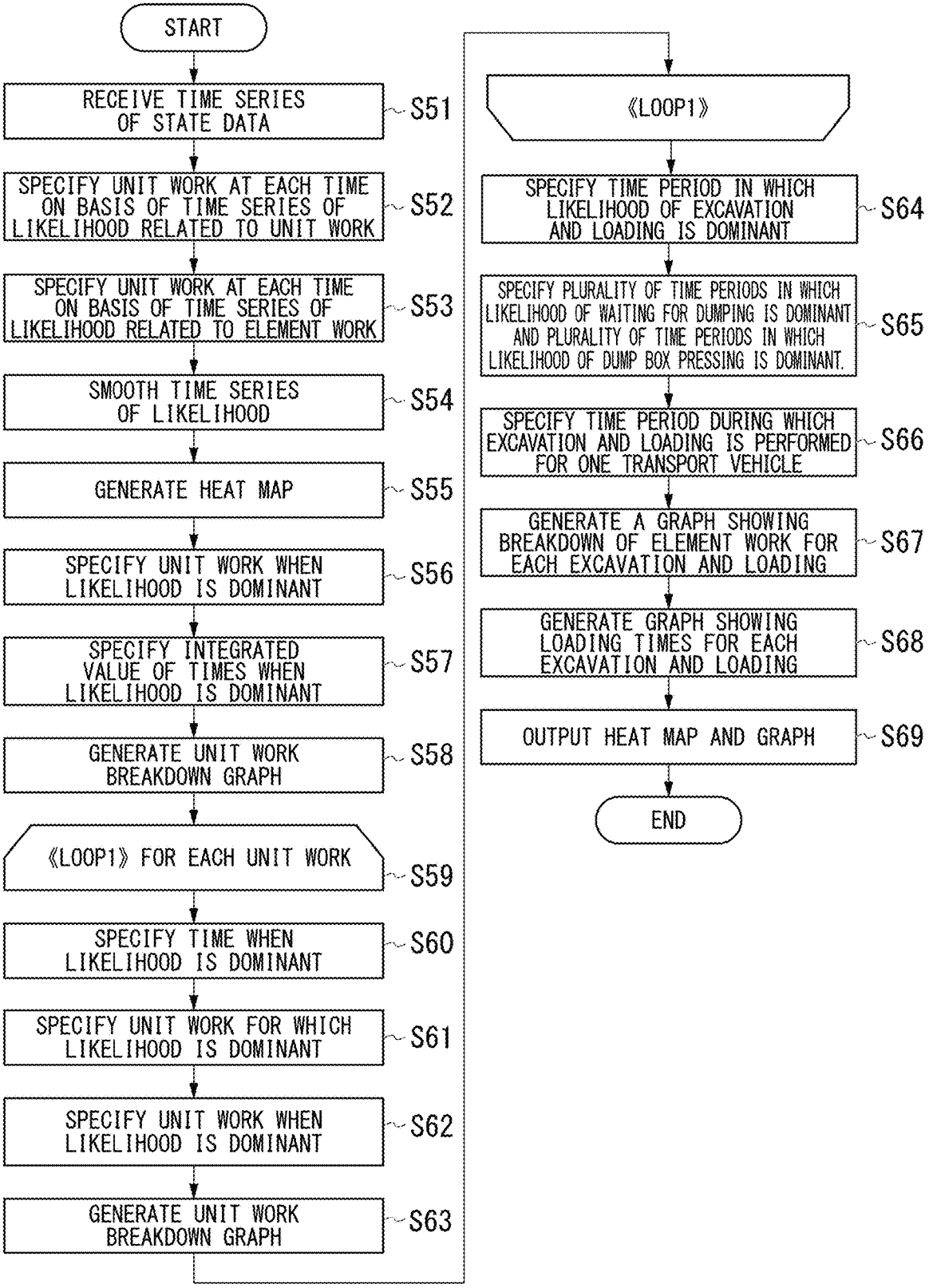
FIG. 10 is a flowchart showing a method of work analysis by the work analysis device according to the first embodiment.

FIG. 10 is a flowchart showing a method of work analysis by the work analysis device according to the first embodiment.

The state data acquisition unit 311 of the work analysis device 300 receives the time series of the state data from one work machine 100 (step S51). Next, the work specification unit 315 inputs the received time series of the state data into the unit work prediction model stored in the model storage unit 334 to obtain the time series of the likelihoods related to the unit works (step S52). Accordingly, the work specification unit 315 specifies the unit work at each time in the time series. Further, the work specification unit 315 inputs the received time series of the state data into the element work prediction model stored in the model storage unit 334 to obtain the time series of the likelihoods related to the element works (step S53). The smoothing unit 316 smooths the time series of the likelihoods by applying the time series of the likelihoods of the unit works and the time series of the likelihoods of the element works to the time average filter, respectively (step S54).

As shown in FIG. 5, the heat map generation unit 317 generates the unit work heat map H1 indicating the smoothed time series of likelihoods related to the unit works and the element work heat map H2 representing the smoothed time series of likelihoods related to the element works (step S55).

The breakdown graph generation unit 318 specifies the unit work with the highest likelihood for each time in the smoothed time series of the likelihoods related to the unit works (step S56). That is, the breakdown graph generation unit 318 specifies the unit work for which the likelihood is dominant for each time. Next, the breakdown graph generation unit 318 obtains an integrated value of the times when the likelihood is dominant for each unit work (step S57). The breakdown graph generation unit 318 generates the unit work breakdown graph G1 as shown in FIG. 6 by drawing the accumulated time for each unit work in a pie chart (step S58).

Next, the breakdown graph generation unit 318 selects the classification of the unit work one by one, and executes the processes of the following steps S60 to S63 (step S59).

The breakdown graph generation unit 318 specifies a plurality of times at which the likelihood of the unit work selected in step S59 is dominant (step S60). The breakdown graph generation unit 318 specifies the unit work for which the likelihood is dominant for each specified time based on the smoothed time series of the likelihoods related to the element works (step S61). Next, the breakdown graph generation unit 318 obtains an integrated value of the times when the likelihood is dominant for each element work (step S62). The breakdown graph generation unit 318 generates the element work breakdown graph G2 as shown in FIG. 6 by drawing the accumulated time for each element work on a pie chart (step S63).

Next, the excavation and loading graph generation unit 319 specifies a time period in which the likelihood of the "excavation and loading" is dominant, based on the smoothed time series of the likelihoods related to the unit works (step S64). Next, the excavation and loading graph generation unit 319 specifies in the specified time period, a plurality of time periods in which the likelihood of the "waiting for dumping" is dominant and a plurality of time periods in which the likelihood of the "dump box pressing" is dominant (step S65). The excavation and loading graph generation unit 319 specifies the period from the end time of the time period in which the likelihood of the "waiting for dumping" is dominant to the start time of the time period in which the likelihood of the "dump box pressing" is dominant, respectively, as the time period during which the excavation and loading is performed for one transport vehicle (step S66).

The excavation and loading graph generation unit 319 specifies the integrated value of the time of each element work for each specified excavation and loading, and generates a graph showing the breakdown of the element works for each excavation and loading as shown in FIG. 7 (step S67). Further, the excavation and loading graph generation unit 319 specifies the number of times of appearance in the time period in which the "loading swing" is dominant for each excavation and loading specified in step S66, and generates a graph showing the number of loadings as shown in FIG. 8 (step S68).

The output unit 320 outputs the heat map generated by the heat map generation unit 317, the breakdown graph generated by the breakdown graph generation unit 318, and the graph indicating information for each excavation and loading generated by the excavation and loading graph generation unit 319 (Step S69).

<Operation and Effect>

As described above, according to the first embodiment, the work analysis device 300 specifies the classification of the unit work and the classification of the element work executed by the work machine based on the state data indicating the state of the work machine 100, and outputs them. The user can recognize the work state of the unit work and the work state of the element work of the work machine 100, and the proportion of the element works that constitute one unit work when skill of an operator is judged and evaluated, and work is analyzed. This allows the user to perform multifaceted analysis of work of the work machine 100.

Further, according to the first embodiment, the work analysis device 300, specifies the classifications of work performed by the work machine based on the state data indicating the state of the work machine 100, and outputs the specified classifications of work in time series. Therefore, the user can comprehensively recognize work of the work machine 100, and can judge a quality of each skill based on work of the operator.

In particular, in the first embodiment, the work analysis device 300 specifies the likelihood of the classification of work of the work machine 100 for each time, and outputs the time series of the likelihood of the classification of work. Specifically, as shown in FIG. 5, the work analysis device 300 generates the heat map in which a plane formed of an axis representing time and an axis representing the classifications of work is colored with colors according to the likelihood. Accordingly, the work analysis device 300 is capable of representing a work state in which a plurality of unit works or a plurality of element works are performed in combination, a stopped non-working state, or a work state that changes seamlessly to a different classification of work on the heat map. That is, by displaying the classifications of work in a time series, it becomes possible to determine whether the operator is working or taking a break as intended. In addition, by using the heat map for representation, the work state in which a plurality of unit works or a plurality of element works are compounded appears as a state in which the likelihoods of a plurality of classifications of work are high at the same time.

The time required for the unit work can be shortened by performing a plurality of element works in a composite manner. In addition, when the main work and the incidental work are performed in a combined manner, although there is a possibility that the setup by the incidental work may be insufficient, there is a possibility that the setup is done efficiently by performing, at the same time as the main work, the incidental work related to another main work. As described above, the state in which a plurality of classifications of work are performed in combination contributes to the evaluation of the skill of the operator, and the work analysis device 300 outputs information to understand such a state. Thus, the operator can easily evaluate the skill of the operator.

Examples of work states in which a plurality of unit works are performed in a combined manner include a state in which the load collecting is preformed while the excavating and loading is preformed, a state in which the load collecting is preformed while the plowing is preformed, and the like. Examples of work states in which a plurality of elemental works are performed in a combined manner include a state in which the pushing and smoothing is performed while the excavating is preformed, a state in which the dump box pressing is preformed while the dumping is preformed, and the like. Further, Examples of seamlessly shifting to a different work is a state in which the dumping is started in the middle of a turn of load collecting is preformed, and the like.

Further, the work analysis device 300 specifies the representative value per unit time by performing the smoothing process on each of the time series of the likelihood of the unit work and the time series of the likelihood of the element work. At this time, the length of the unit time related to the element work is shorter than the length of the unit time related to the unit work. This is because the duration of one element work is shorter than the duration of one unit work, as the unit work consists the element works.

Further, the unit work according to the first embodiment includes a main work and an incidental work. Specifically, as shown in FIG. 5, the work analysis device 300 outputs the unit work heat map H1 including the main work such as the excavation and loading, or the like, and the incidental work such as the load collection, the driving, or the like. This allows the user to recognize what work the work machine 100 was doing other than the main work such as the excavation and loading, or the like. As a result, the user can specify the incidental work required to efficiently perform the excavation and loading.

Further, according to the first embodiment, the work analysis device 300 outputs the element work breakdown graph G2 indicating the time and the ratio of each element work that constitutes one unit work. Thus, when evaluating the unit work of the work machine 100, the user can specify the classifications of the element works constituting of the unit work.

Specifically, the work analysis device 300 outputs the element work breakdown graph G2 as shown in FIG. 6, so that the user can recognize the ratios of the "excavation", the "loading swing", the "dumping", the "unloading swing", the "waiting for dumping" and the "dump box pressing", in the "excavation and loading" when the user performs the evaluation of the "excavation and loading". This allows the user to properly evaluate the excavation and loading.

In particular, the work analysis device 300 is capable of specifying the loading start timing by specifying the "waiting for dumping" and is capable of specifying the loading end timing by specifying the "dump box pressing". Further, the work analysis device 300 specifies the "excavation", the "loading swing", the "dumping", and the "unloading swing" so that it is possible to evaluate work of the operator and compare the performance with the plan when work state is statistically collected.

The work analysis device 300 according to the first embodiment outputs a graph showing a breakdown of the element works for each excavation and loading as shown in FIG. 7. As a result, the user can recognize the time required to load the transport vehicle and further recognizing the cause when the time required to load the transport vehicle is long. In the example shown in FIG. 7, it can be seen that the excavation and loading time at 14:44 is longer than other excavation and loading. With reference to the breakdown of the element works that constitutes the excavation and loading at 14:44, it can be seen that the waiting time for dumping is longer than that of other excavation and loading. Therefore, it can be seen that in the excavation and loading at 14:44, since the arrival interval of the transport vehicle is long, the excavation and loading time becomes long.

The work analysis device 300 according to the first embodiment outputs a graph showing the number of loadings for each excavation and loading as shown in FIG. 8. The user can recognize skill of the operation by the operator by recognizing the number of loadings on the transportation vehicle. In the example shown in FIG. 8, it can be seen that the number of loadings at 15:00 is higher than that of other excavation and loading. Therefore, it can be inferred that in the excavation and loading at 15:00, an event such as a small amount of earth to be loaded in the bucket 133 or an overflow of earth from the transport vehicle at the time of loading occurred.

<Others>

One embodiment has been described in detail above with reference to the drawings, the specific configuration is not limited to the above, and various design changes and the like are possible.

In the above-described embodiment, the data collecting device 128 of the work machine 100 transmits the measured value of each sensor to the work analysis device 300, and the work analysis device 300 specifies the classification of work based on the measured value, but other embodiments are not limited to this configuration. For example, in another embodiment, the data collecting device 128 may specify the classification of work based on the measured value of each sensor. For example, in another embodiment, the prediction model generated by the work analysis device 300 may be stored in the data collecting device 128, and the data collecting device 128 may use the prediction model to specify the classification of work. That is, in another embodiment, the work analysis device 300 may be provided in the data collecting device 128. In this case, the data collecting device 128 may cause the display mounted on the work machine 100 to display the analysis result of the current classification of work in real time. As a result, the operator can perform work while recognizing the classification of work.

The work analysis device 300 according to the above-described embodiment specifies the time series of the likelihood of each classification of work, but other embodiments are not limited to this configuration, and the time series of the true/false value of each classification of work may be specified. Even in this case, the work analysis device 300 is capable of obtaining the time series of the likelihoods of classifications of work by smoothing the specified time series.

Further, the labeling device 200 according to the above-described embodiment generates label data based on the user's operation, but other embodiments are not limited to this configuration. For example, the labeling device 200 according to another embodiment may automatically generate label data by image processing or the like.

Further, the work analysis device 300 according to the above-described embodiment specifies the classification of work of the work machine 100 based on the learned prediction model, but other embodiments are not limited to this configuration. For example, the work analysis device 300 according to another embodiment may specify the classification of work of the work machine 100 based on a program that does not rely on a machine learning. A program that does not rely on a machine learning is a program that specifies the classification of work from a combination of operations that are defined in advance based on the input of state data. In this case, the state analysis system 1 may not include the imaging device 127, the labeling device 200, the moving image acquisition unit 312, the label data acquisition unit 313, the learning unit 314, the moving image storage unit 332, and the label data storage unit 333.

Further, the work analysis device 300 according to the above-described embodiment evaluates the classification of work based on the detection values of the plurality of sensors or the values calculated based on the detection values, but other embodiments are not limited to this configuration. For example, the work analysis device 300 according to another embodiment may evaluate the classification of work based on the moving image captured by the imaging device 127. That is, the image captured by the imaging device 127 may be an example of state data indicating the state of the work machine 100.

Further, the data collecting device 128 according to the above-described embodiment stores the state data in the storage unit in association with the time stamp and transmits it to the work analysis device 300 as a time series of the state data, but other embodiments are not limited to this configuration. For example, the data collecting device 128 according to another embodiment may sequentially transmit the collected state data to the work analysis device 300 in association with the time stamp. In this case, the work analysis device 300 sequentially acquires the combination of the state data and the time stamp, and totalizes them as a time series.

According to the present invention, the manager can perform multifaceted analysis on work of the work machine based on the information on the unit work and the element work specified by the work analysis device.

The invention claimed is:

1. A work analysis device comprising:

a memory storing a program; and a processor configured to execute the program, the processor including, by executing the program, a state data acquisition unit configured to acquire, from a plurality of sensors, state data indicating a state of a work machine at multiple times;

a work specification unit configured to specify, based on the acquired state data, a classification of work of the work machine for each of the multiple times, and to collect the classification of work in a chronological order; and an output unit configured to output a time series of the specified classification of work, the work specification unit is further configured to specify a classification of a unit work that indicates work carrying out one work goal for the work machine, to specify a classification of an element work, the element work constituting the unit work and indicating a series of actions or work classified by purpose, and to collect, in a chronological order, the classification of the unit work constituted of the element work, and the output unit being further configured to output a time series of the specified classification of the unit work constituted of the element work.

2. The work analysis device according to claim 1, wherein the work specification unit is further configured to specify a likelihood of each of multiple classifications of work at each time, the output unit is further configured to output a time series of likelihoods of the multiple classifications of work.

3. The work analysis device according to claim 2, wherein the output unit is further configured to output a heat map colored in colors corresponding to the likelihoods to a space including an axis indicating time and an axis indicating the classifications of work.

4. The work analysis device according to claim 1, wherein the work specification unit is further configured to specify the likelihood of the classification of work in a unit time, and the unit time related to the unit work is shorter than the unit time related to the element work.

5. A method of work analysis comprising:

acquiring, from a plurality of sensors, state data indicating a state of a work machine at multiple times;

specifying, based on the acquired state data, a classification of work of the work machine for each of the multiple times, and collecting the classification of work in a chronological order;

outputting a time series of the specified classification of work, specifying a classification of a unit work that indicates work carrying out one work goal for the work machine, specifying a classification of an element work, the element work constituting the unit work and indicating a series of actions or work classified by purpose, collecting, in a chronological order, the classification of the unit work constituted of the element work, and outputting a time series of the specified classification of the unit work constituted of the element work.

* * * * *